United States Patent [19]

Yamagishi et al.

[11] 4,021,188

[45] May 3, 1977

[54] BURNER CONFIGURATIONS FOR STAGED COMBUSTION

[75] Inventors: Kazuo Yamagishi, Urawa; Ichiro Nakamachi, Abiko; Masaaki Nozawa, Yokohama; Tsunenori Tokumoto, Yokosuka; Shoichi Yoshie, Kawasaki; Yasuo Kakegawa, Tokyo; Isamu Kikuchi, Yokohama; Yoshihisa Iseda, Tokyo; Yoshihiro Kanno, Yokohama; Sadanori Yamazaki, Tokyo; Masanobu Sato, Asaka, all of Japan

[73] Assignee: Tokyo Gas Company Limited, Tokyo, Japan

[22] Filed: Aug. 21, 1975

[21] Appl. No.: 606,605

Related U.S. Application Data

[63] Continuation of Ser. No. 450,246, March 11, 1974, abandoned.

[30] Foreign Application Priority Data

| | | |
|---|---|---|
| Mar. 12, 1973 | Japan | 48-28774 |
| Mar. 19, 1973 | Japan | 48-31590 |
| Mar. 19, 1973 | Japan | 48-31591 |
| Mar. 31, 1973 | Japan | 48-37139 |
| Mar. 31, 1973 | Japan | 48-37141 |
| Mar. 31, 1973 | Japan | 48-37142 |
| June 27, 1973 | Japan | 48-76439[U] |
| June 27, 1973 | Japan | 48-76440[U] |
| June 27, 1973 | Japan | 48-76442[U] |
| July 4, 1973 | Japan | 48-79539[U] |
| Aug. 17, 1973 | Japan | 48-91682 |

[52] U.S. Cl. ..... 431/158; 431/10; 431/353; 431/9

[51] Int. Cl.[2] ..... F23R 1/00

[58] Field of Search ..... 431/10, 158, 351, 347, 431/353, 9; 239/432

[56] References Cited

UNITED STATES PATENTS

| | | | |
|---|---|---|---|
| 669,988 | 3/1901 | Hayes | 431/10 |
| 3,730,668 | 5/1973 | Iida et al. | 431/10 |
| 3,799,732 | 3/1974 | Brodlin | 431/347 |
| 3,837,788 | 9/1974 | Craig et al. | 431/10 X |

*Primary Examiner*—Edward G. Favors
*Attorney, Agent, or Firm*—Wenderoth, Lind & Ponack

[57] ABSTRACT

Burner arrangements for staged combustion to decrease nitrogen oxides (NOx) during the combustion of hydrocarbon fuel with air. The burner arrangements have a combustion into which hydrocarbon fuel and less than 70% of the stoichiometric air are introduced, and a path for the secondary air around the combustion chamber. A flame holding means is provided in one end of the combustion chamber to stabilize the substoichiometric combustion so that a partially burned gas containing mainly $H_2$ and CO as combustible components is obtained. The combustion chamber has an exit, and there is an exit from the secondary air path near the exit of the combustion chamber. A discharging means for the partially burned gas is provided at the exit of the combustion chamber to vary the pattern of the flow of said partially burned gas by converting the enthalpy of said partially burned gas into kinetic energy. A discharging means for the secondary air is also provided at the exit for the secondary air to vary the pattern of the flow of the secondary air.

35 Claims, 67 Drawing Figures

FIG. 5
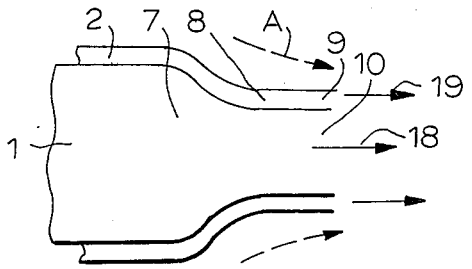
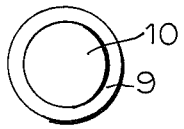
FIG. 5A
FIG. 6
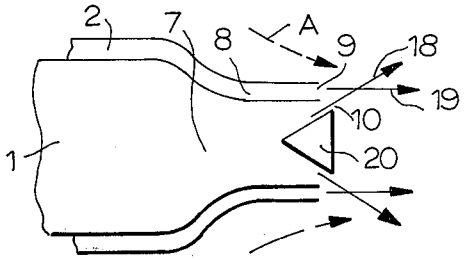
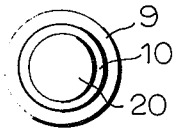
FIG. 6A
FIG. 7
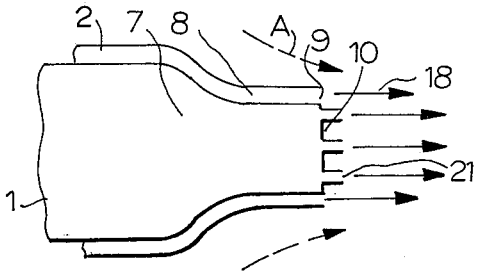
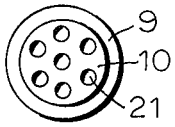
FIG. 7A
FIG. 8
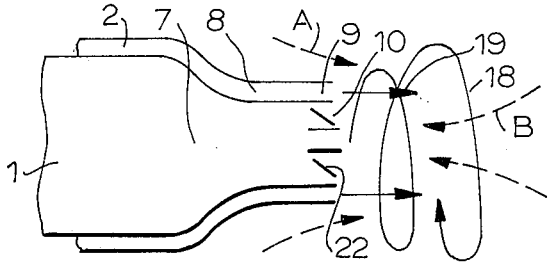
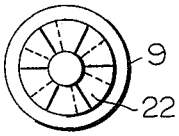
FIG. 8A
FIG. 9
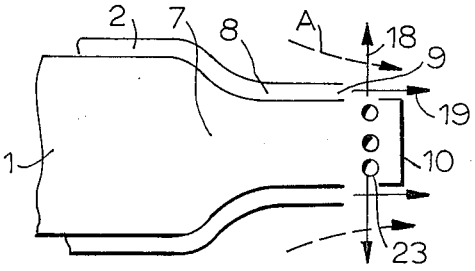
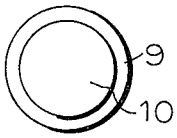
FIG. 9A FIG.15
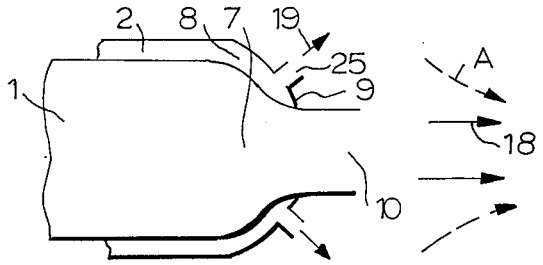
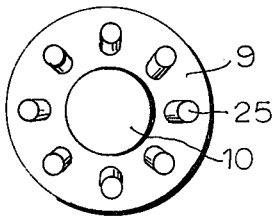
FIG.15A
FIG.16
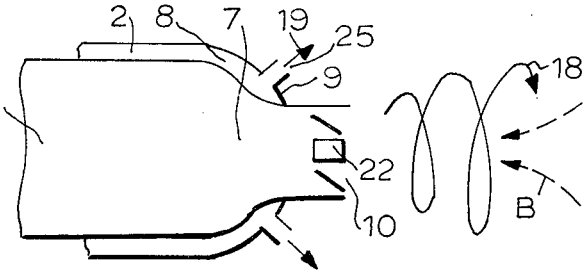
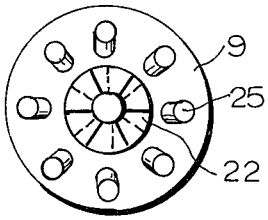
FIG.16A
FIG.17
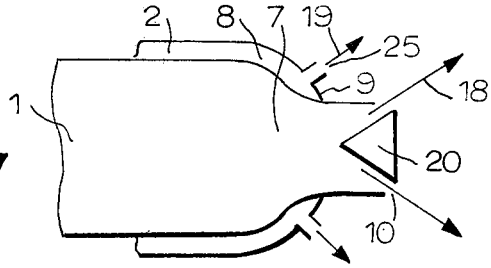
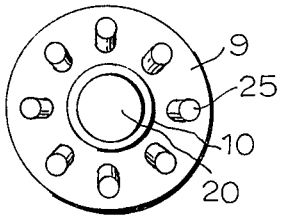
FIG.17A
FIG.18
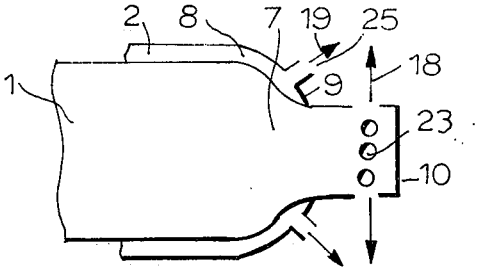
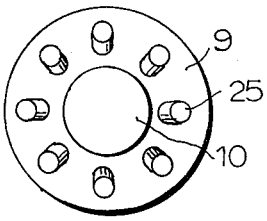
FIG.18A
FIG.19
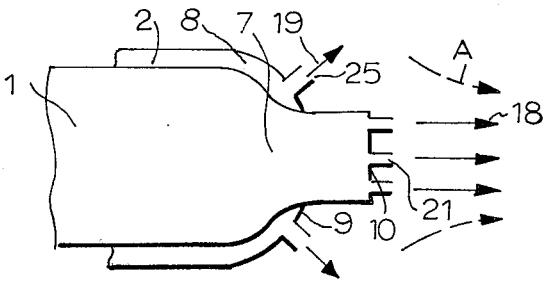
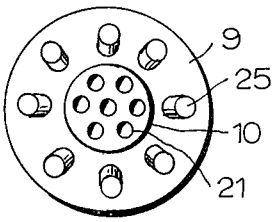
FIG.19A FIG. 20
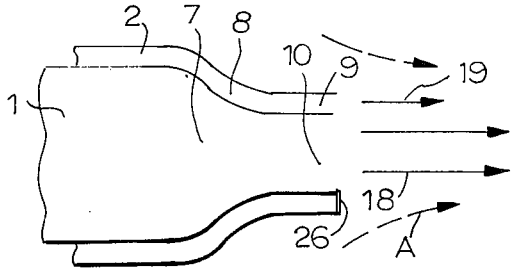
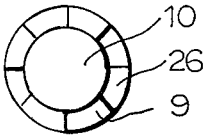
FIG. 20A
FIG. 21
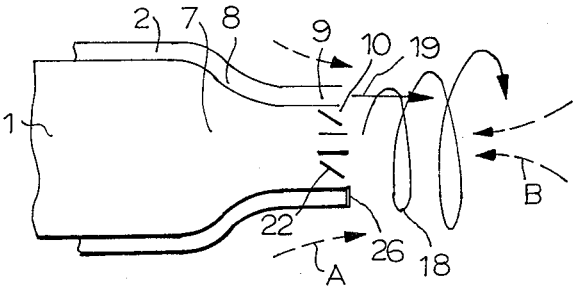
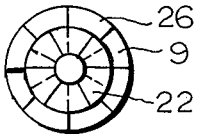
FIG. 21A
FIG. 22
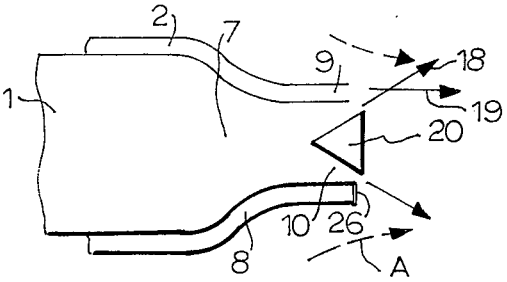
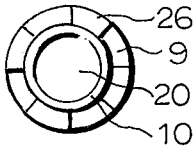
FIG. 22A
FIG. 23
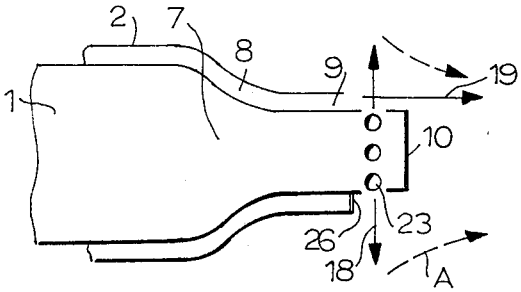
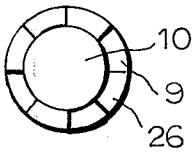
FIG. 23A
FIG. 24
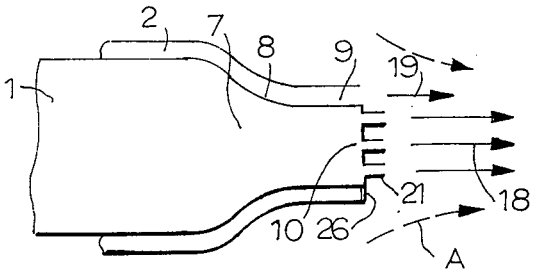
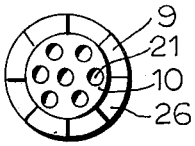
FIG. 24A

BURNER CONFIGURATIONS FOR STAGED COMBUSTION

This is a continuation of application Ser. No. 450,246, filed Mar. 11, 1974 abandoned.

DETAILED DESCRIPTION OF THE INVENTION

Figure 1:
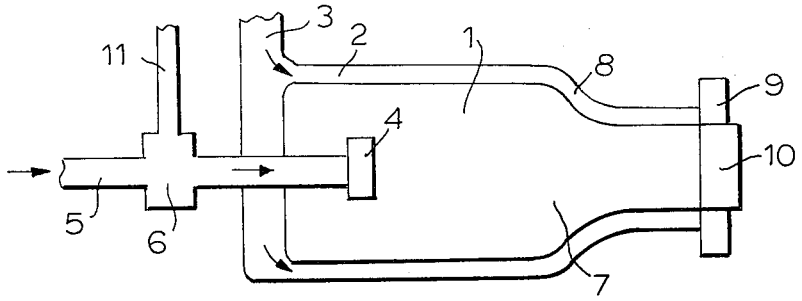

This invention relates to burner configurations which are capable of suppressing to a very low level the nitrogen oxides (NOx) formed in combustion of hydrocarbon fuels with air. It is known generally that a staged combustion is an effective means for reducing NOx, and in accordance with the present invention, there are provided burner configurations which develop the staged combustion more effectively.

The invention will be described in greater detail in connection with the drawing, in which:

FIG. 1 is a schematic view of a basic burner configuration according to the present invention;

FIGS. 2 and 2*a* to FIGS. 5 and 5*a* are schematic side and end views, respectively, of specific flame holding means; and FIGS. 6 and 6*a* to FIG. 34 and 34*a* are schematic side and end views, respectively, of specific secondary air and partial combustion gas discharge means.

Figure 2:
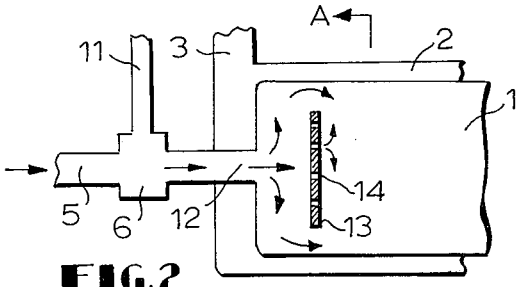
Figure 2A:
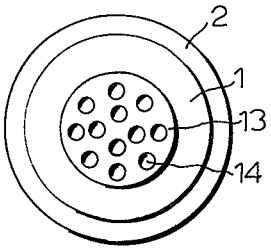
Figure 3:
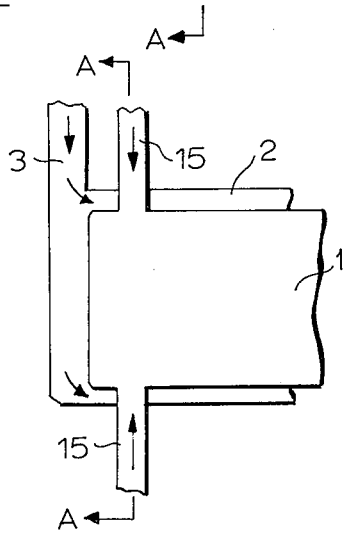
Figure 3A:
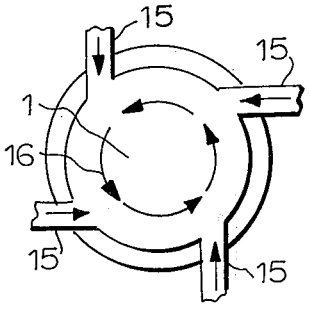
Figure 4:
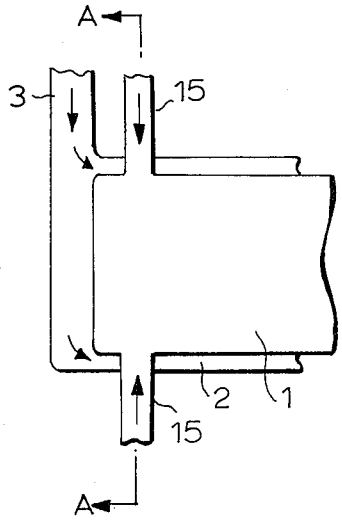
Figure 4A:
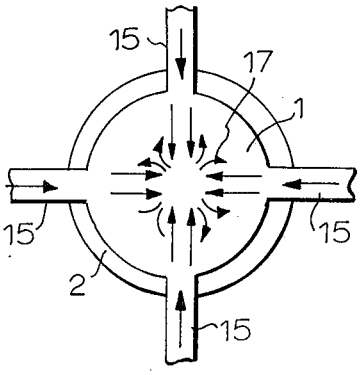
Figure 10:
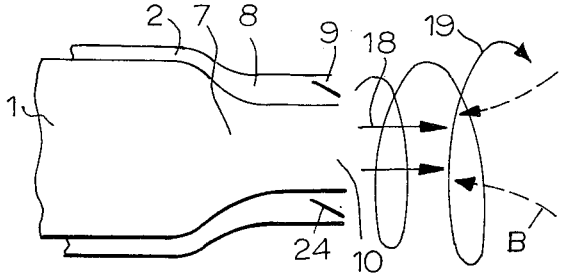
Figure 10A:
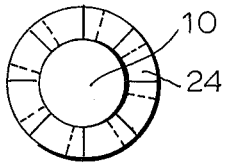
Figure 11:
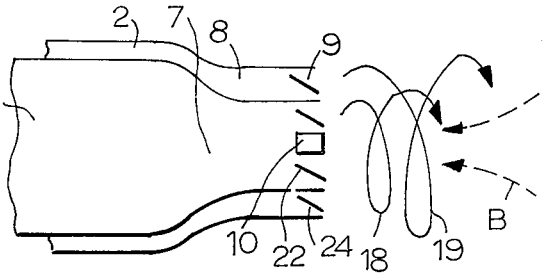
Figure 11A:
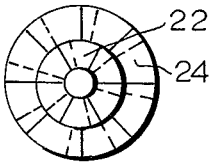
Figure 12:
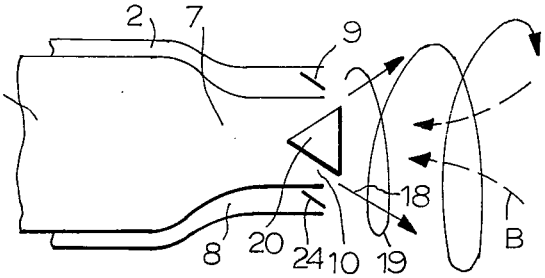
Figure 12A:
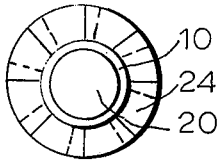
Figure 13:
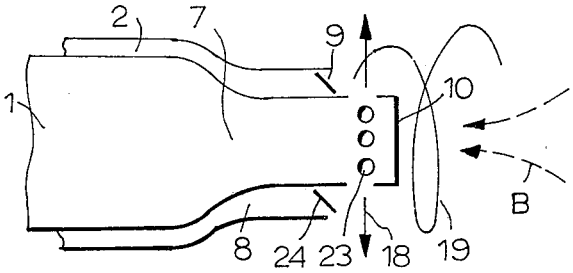
Figure 13A:
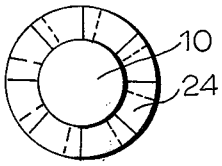
Figure 14:
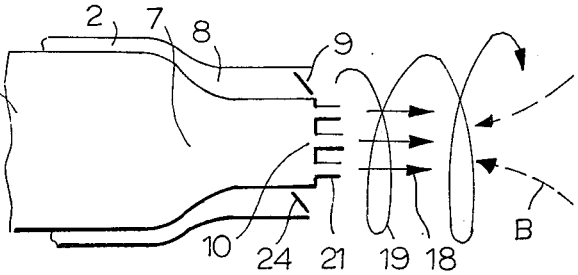
Figure 14A:
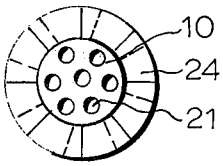
Figure 25:
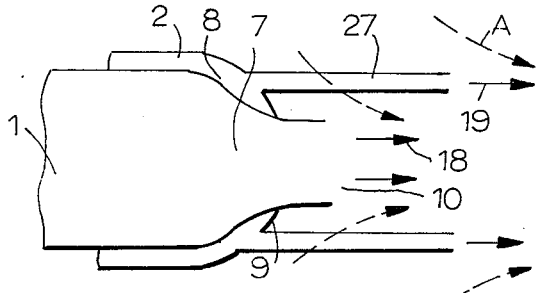
Figure 25A:
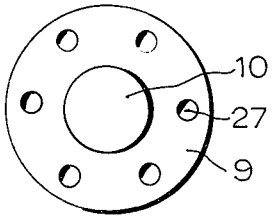
Figure 26:
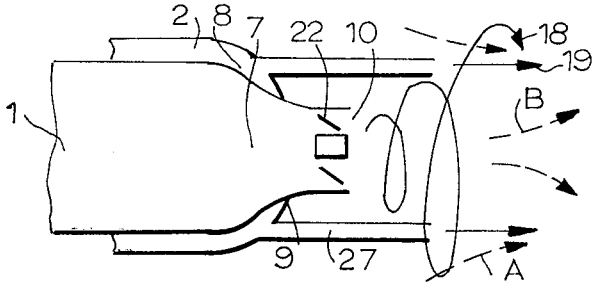
Figure 26A:
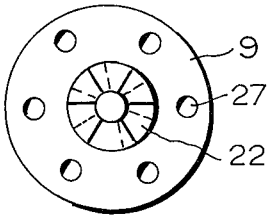

The basic configuration of the present invention is shown in FIG. 1, in which numeral 1 represents a combustion chamber. A hydrocarbon fuel and air in an amount less than 70% of stoichiometric are introduced into said combustion chamber 1, and substoichiometric combustion is carried out. There is provided a path 2 of the secondary air which is needed for the completion for the combusion around said combustion chamber 1. Said secondary air is introduced through the secondary air inlet 3. On one side of said combustion chamber 1, a flame holding means 4 is provided to stabilize said substoichiometric combustion. In the case of FIG. 1, the premix combustion is illustrated for said substoichometric combustion, and less than 70% of stoichiometric air, introduced through the air inlet 11, and the fuel introduced through the fuel inlet 5, are introduced to the mixer 6. Said mixer 6 can be placed in said combustion chamber 1. Further, said fuel and said air can also be introduced independently without said mixer 6 into said combustion chamber 1. The mixture thus obtained is introduced into said combustion chamber 1. An example of said flame holding means 4 is shown in FIG. 2. In FIG. 2 numeral 1 is said combustion chamber, and numeral 2 represents a nozzle for said mixture of fuel and less than 70% of the stoichiometric air. In front of said nozzle 12 there is placed a flame holding plate 13, which has many appropriate small holes 14. The spouting flow, discharged from said nozzle 12, collides against said flame holding plate 13, and produces many recirculating flows as shown by arrows in FIG. 2, around said nozzle 12, around said small holes 14, and around said flame holding plate 13. These recirculating flows make the flame stable by continuously igniting said mixture. Almost the same effect is obtainable by another flame holding means illustrated in FIG. 3. In this figure, numeral 1 is said combustion chamber, and there installed single or plural nozzles 15 for said mixture of fuel and air, in the tangential direction around said combustion chamber 1. In this case, the spouting flows of said mixture, discharged from said nozzles 15, produce a circulating flow 16 in said combustion chamber 1 and said circulating flow 16 stabilizes the flame. In FIG. 3, four nozzles 15 are illustrated, but any number of said nozzles 15 can be used if a circulating flow 16 is obtained in said combustion chamber 1. Further, as illustrated in FIG. 4, plural nozzles 15, which are provided perpendicular to the axis of said combustion chamber 1 so that the spouting flows collide each other and numerous turbulent flows 17 are formed in said combustion chamber 1, can be used for said flame stabilizing means. In this case, said turbulent flows 17 make the flame stable by offering continuous ignition to said mixture. Preferably said substoichiometric combustion in said combustion chamber 1 is a premixed one to decrease NOx, but diffusion combustion is advantageous from the point of the stability of the combustion. Thus, said substoichiometric combustion proceeds in said combustion chamber 1. In the present invention, it is one of the most important points to promote said substoichiometric combustion sufficiently in said combustion chamber 1 so that the partial combustion gas containing mainly $H_2$ and CO as combustible components is obtained without unburned hydrocarbons. Said partial combustion gas is discharged from said combustion chamber 1 through the exit for the partial gas, illustrated by numeral 7 in FIG. 1. On the other hand, the secondary air passes through the secondary air path 2 and is discharged from the exit 8 for the secondary air, and thus is supplied to said partial combustion gas for the secondary combustion outside of said combustion chamber 1. At said exit 8 for the secondary air there is provided a discharging means 9 for the secondary air to vary the pattern of the flow of said secondary air. A discharging means 10 for the partial combustion gas is provided at said exit 7 for the partial combustion gas to vary the pattern of the flow of said partial combustion gas. The discharging means 9; 10 for the secondary air and the partial combustion gas are illustrated schematically in FIG. 1.

Now there will be explained the mechanism of suppressing NOx in the present invention. In said combustion chamber 1, the combustion is carried out under an extremely low amount of substoichiometric air so that the formation of NOx is suppressed so that it is that a minimum. Therefore, almost no NOx is contained in said partial combustion gas. Further, said partial combustion gas is supplied with said secondary air needed for the completion of the combustion outside of said combustion chamber 1, and the secondary combustion is carried out. In order to suppress the formation of NOx during said secondary combustion, it is important to avoid the formation of a local high temperature region and a local oxygen rich region and to lower the combustion temperature. In the conventional staged combustion method, it is rather difficult to avoid the formation of a local high temperature region and an oxygen rich region and to lower the combustion temperature sufficiently, because the combustion modifications for such purposes cause soot formation. As an example, when the gas is cooled sufficiently before the supply of the secondary air in order to lower the combustion temperature, it becomes difficult to complete the secondary combustion without the soot formation. In the present invention the substoichiometric combustion is sufficiently carried out in said combustion chamber 1 to obtain a partial combustion gas which contains mainly $H_2$ and CO as combustible components, and said partial combustion gas is led to the complete combustion outside of said combustion zone chamber 1. In this method, since the main combustible components of said partial combustion gas are $H_2$ and CO, and there remains little unburned hydrocarbons, no soot formation occurs even if said partial combustion gas is sufficiently cooled before the supply of the secondary air. Further, said partial combustion gas has excellent burning properties, and thus completion of the combustion is easily carried out. In the present invention since said substoichiometric combustion is carried out independently in said combustion chamber from the secondary combustion, and is completed, the secondary combustion is easily completed without soot formation even if the pattern of said secondary combustion is varied freely, and said primary substoichiometric combustion is not influenced by said secondary combustion whatever the pattern of said secondary combustion may be. This distinctive feature of the present invention offers a great advantage in the use of these burner configurations to furnaces in suppress NOx. That is, in order to decrease NOx, it is generally required, as described above, to lower the combustion temperature and to avoid the formation of a local high temperature region and a local oxygen rich region, and in order to satisfy these conditions the optimum pattern of the secondary combustion must be selected for each actual furnace. In the present invention, by the use of the previously described advantages, the optimum pattern can be established whatever the type of the furnace may be. The discharging means 10 for the partial combustion gas and the discharging means 9 for the secondary air in FIG. 1 are provided in order to vary the pattern of the secondary combustion freely, and said means are designed as shown in the figures from FIG. 5 to FIG. 34, where the unlettered figures are schematic side sectional views and the lettered figures are schematic end views of the burner configurations respectively. In each figure from FIG. 5 to FIG. 34, numeral 1 is said combustion chamber, numeral 2 is the path of said secondary air, numeral 9 is said discharging means for the secondary air, numeral 10 is said discharging means for the partial combustion gas, numeral 19 is the secondary air, and numeral 18 is the partial combustion gas, respectively. In FIGS. 5, 10, 15, 20, 25 and 30 said discharging means 10 for the partial combustion gas 18 is illustrated, which comprises a nozzle at said exit 7 of the combustion chamber 1, to discharge said partial combustion gas 18 in a jet. This partial combustion gas stream 18 accompanies surrounding relatively low temperature combustion gas, as represented by symbol A in each figure so that said partial combustion gas 18 is cooled, and gradually mixes with the secondary air 19 because of the high velocity of said partial combustion gas stream 18 and therefore, the secondary combustion proceeds slowly. In this pattern of the secondary combustion, said partial combustion gas 18 burns after dissipating heat sufficiently and being cooled enough, so that the formation of NOx is suppressed. Just the same effects are obtainable by dividing said partial combustion gas 18 with plural nozzles 21 as illustrated in FIGS. 7, 14, 19, 24, 29 and 34 and in each figure said accompanying flow of the surrounding completely burned gas is represented by symbol A. Further, a rotating means is used as said discharging means 10 for said partial combustion gas in the examples illustrated in FIGS. 8, 11, 16, 21, 26 and 31. Any rotating means can be used such as blades or slits 22, if a rotating flow of said partial combustion gas 18 is obtained. In these cases, because of said rotating flow of said partial combustion gas 18 the surface area of said partial combustion gas 18 rapidly increases, and the temperature of said partial combustion gas 18 is readily lowered and besides, surrounding relatively low temperatures combustion gas is attracted into the center of said rotating flow of said partial combustion gas 18, as shown in each figure by symbol B. The partial combustion gas 18 is cooled by these effects, and therefore, the combustion temperature is lowered so that NOx formation is suppressed. In FIGS. 6, 12, 17, 22, 27 and 32, there are illustrated other discharging means 10 for said partial combustion gas 18 which comprises a cone 20 at said exit 7 of said partial combustion gas 18 to discharge said partial combustion gas 18 in a circular flow of said partial combustion gas 18 with an enlarged surface, so that the partial combustion gas 18 is cooled readily by the rapid dissipation of its heat. This rapid cooling is remarkably effective for decreasing NOx. The same results are obtainable by using the discharging means 10 illustrated in FIGS. 9, 13, 18, 23, 28 and 33, which comprises appropriate holes 23 to discharge said partial combustion gas 18 perpendicular to the original stream of said partial combustion gas 18 so that the surface of said partial combustion gas 18 is enlarged. On the other hand, it is effective for decreasing NOx in the secondary combustion to avoid a local high temperature region and an oxygen rich region, and to lower the combustion temperature, as previously described, by supplying said secondary air 19 gradually to said partial combustion gas 18. Further, it is preferable that said secondary air 19 be diluted by the completely burned gas shown by arrow A before mixing with said partial combustion gas 18 so that the oxygen concentration of said secondary air 19 is decreased. In FIGS. 5, 6, 7, 8 and 9 said discharging means 9 comprises an annular nozzle, and by discharging said secondary air 19 at high velocity, the mixing with said partial combustion gas 18 becomes slow and surrounding completely burned gas is attracted as represented in symbol A in each figure so that the oxygen concentration is lowered. In FIGS. 10, 11, 12, 13 and 14 a rotating means 24 is used for said discharging means 9 to that said secondary air 19 is discharging in a rotating flow which attracts surrounding completely burned gas as represented in symbol B by each figure. By this flow pattern, not only is the oxygen concentration decreased but also the mixing with the partial combustion gas 18 becomes slow. In FIGS. 15, 16, 17, 18 and 19, there is illustrated other discharging means 9 comprising plural nozzles 20 placed radially around said exit 8 of the secondary air so that the divided radial flows of said secondary air 19 are obtained, and mix gradually with said partial combustion gas 18. Further, in FIGS. 20, 21, 22, 23 and 24, said discharging means 9 to said secondary air 19 comprises plural dividers 26 with their appropriate parts closed to form divided air flows of said secondary air 19 so that said secondary air 19 accompanies surrounding completely burned gas as represented by symbol A, and the oxygen concentration of said secondary air 19 decreases. In FIGS. 25, 26, 27, 28 and 29, said discharging means 9 to said secondary air 19 comprises elongated plural pipes 27 to discharge said secondary air 19 downstream of said partial combustion gas 18 so that the mixing with said partial combustion gas 18 is made possible only after some lapse of time. The use of said elongated pipes 27 is remarkably effective for gradual mixing. Besides, since said secondary air 19 accompanies surround completely burned gas as shown in symbol A in each figure, the effect of lowering the oxygen concentration is also attainable. FIGS. 30, 31, 32, 33 and 34 illustrate said discharging means 9 for said secondary air 19 as comprising plural elongated pipes 28 arranged in a circle and having outwardly directed openings to discharge said secondary air 19 to outwardly of said circle. In these cases, the mixing between said secondary air 19 and said partial gas 18 is gradual and uniform so that it becomes possible to avoid a local high temperature region and an oxygen rich region. Thus the formation of NOx is effectively suppressed. Finally, we must add the particular merit of the present invention. That is, in the discharging means 10 for said partial combustion gas 18 described above, it is possible to convert the enthalpy of the high temperature partial combustion gas to kinetic energy so that more powerful streams of said partial combustion gas 18 are obtained. For example, when the rotating means is used as said discharging means, the rotating flow thus obtained is far more powerful. In other discharging means described above, there are also attained powerful streams. Thus, as explained closely above, it is a fundamental condition for suppressing NOx to promote substoichiometric combustion of hydrocarbon fuel with less than 70% of the stoichiometric air and obtain a partial combustion gas which contains mainly $H_2$ and CO as combustible components and contains little unburned hydrocarbon and Nox, and besides, has excellent burning properties. By the use of the arrangements of the present invention, it becomes possible to vary the pattern of the secondary combustion extremely freely as illustrated in the figures from FIG. 5 to FIG. 34, and to complete the combustion without soot formation. Further, by the configurations of the present invention, that is, the substoichimetric combustion is carried out independently, any variations of the secondary combustion has no influence on the substoichiometric combustion in said combustion chamber. This is an extremely excellent characteristic for application to furnaces. As described above, the present invention offers a means to suppress NOx to an extremely low level.

What is claimed is:

1. A burner configuration adapted to be positioned in a furnace for carrying out staged combustion in order to decrease nitrogen oxides (NOx) during the combustion of hydrocarbon fuel with air, comprising:

a. a combustion chamber and means for supplying into one end of said combustion chamber a mixture of hydrocarbon fuel and air in an amount less than 70 % of the stoichiometric amount;

b. flow path means surrounding and extending along said combustion chamber for flowing secondary air around and along said combustion chamber;

c. a flame holding means in said one end of said combustion chamber for stabilizing the substoichiometric combustion, said flame holding means being a nozzle for said mixture of hydrocarbon fuel and air, and a foraminate plate in front of and spaced from said nozzle, and having a size smaller than the cross-sectional area of said combustion chamber, whereby partial combustion gas containing mainly $H_2$ and CO as combustible components and substantially no hydrocarbon is obtained;

d. said combustion chamber having an exit at the other end thereof;

e. said flow path means having an exit adjacent said exit of said combustion chamber;

f. a partial combustion gas discharging means at said exit of said combustion chamber for varying the pattern of the flow of said partial combustion gas during its discharge from said combustion chamber exit by converting the enthalpy of said partial combustion gas into kinetic energy;

g. a secondary air discharging means at said exit of said flow path means for varying the pattern of the flow of said secondary air; and h. at least one of said discharging means varying the flow of the gas flowing therethrough to mix burned gas from the space around said exit of said combustion chamber into the partial combustion gas and secondary air.

2. A burner configuration as claimed in claim 1 in which said foraminate plate is perpendicular to the axis of said nozzle and the edges of said plate are spaced from the wall of the combustion chamber for producing a flow of gas around the edges of said plate which will produce recirculation of the gas toward the downstream side of said foraminate plate.

3. A burner of configuration as claimed in claim 2 in which said foraminate plate is a substantially flat plate.

4. The invention set forth in claim 1 wherein said flame holding means comprises single or plural nozzles for said mixture placed in tangential direction around said combustion chamber so that a rotating flow is formed in said combustion chamber by spouting said mixture from said single or plural nozzles.

5. The invention set forth in claim 1 wherein said flame holding means comprises plural nozzles placed around said combustion chamber in perpendicular direction to the axis of said combustion chamber so that the spouting flows collide each other in said combustion chamber.

6. The invention set forth in claim 1 wherein said discharging means of said secondary air comprises a spouting slit of said secondary air in a concentric form at said exit of said secondary air, and said discharging means of said partial combustion gas comprises a nozzle at said exit of said partial combustion gas to spout said partial combustion gas in a jet.

7. The invention set forth in claim 1 wherein said discharging means of said secondary air comprises a spouting slit of said secondary air, and said discharging means of said partial combustion gas comprises a cone at said exit of the partial combustion gas to spout said partial combustion gas in a circular flow having an enlarged surface.

8. The invention set forth in claim 1 wherein said discharging means of said secondary air comprises a spouting slit of said secondary air in a concentric form at said exit of said secondary air, and said discharging means of said partial combustion gas comprises plural nozzles at said exit of the partial combustion gas to spout said partial combustion gas in divided plural jet streams.

9. The invention set forth in claim 1 wherein said discharging means of said secondary air comprises a spouting slit of said secondary air in a concentric form at said exit of said secondary air, and said discharging means of said partial combustion gas comprises a rotating means at said exit of the partial combustion gas to spout said partial combustion gas in a rotating flow.

10. The invention set forth in claim 1 wherein said discharging means of said secondary air comprises a spouting slit of said secondary air in a concentric form at said exit of said secondary air, and said discharging means of said partial combustion gas comprises appropriate holes at said exit of the partial combustion gas to spout said partial combustion gas in perpendicular directions to the original stream of said partial combustion gas.

11. The invention set forth in claim 1 wherein said discharging means of said secondary air comprises a rotating means for discharging said secondary air at said exit of said secondary air to form a rotating flow, and said discharging means of said partial combustion gas comprises a nozzle at said exit of the partial combustion gas to spout said partial combustion gas in a jet.

12. The invention set forth in claim 1 wherein said discharging means of said secondary air comprises a rotating means for discharging said secondary air at said exit of said secondary air to form a rotating flow, and said discharging means of said partial combustion gas comprises a rotating means at said exit of the partial combustion gas to spout said partial combustion gas to form a rotating flow.

13. The invention set forth in claim 1 wherein said discharging said secondary air at said exit of said secondary air to form a rotating flow, and said discharging means of said partial combustion gas comprises a cone at said exit of the partial combustion gas to spout said partial combustion gas to form a circular flow having an enlarged surface.

14. The invention set forth in claim 1 wherein said discharging means of said secondary air comprises a rotating means for discharging said secondary air at said exit of said secondary air to form a rotating flow, and said discharging means of said partial combustion gas comprises appropriate holes at said exit of the partial combustion gas to spout said partial combustion gas in perpendicular directions to the original stream of said partial combustion gas.

15. The invention set forth in claim 1 wherein said discharging means of said secondary air comprises a rotating means for discharging said secondary air at said exit of said secondary air to form a rotating flow, and said discharging means of said partial combustion gas comprises plural nozzles at said exit of the partial combustion gas to spout said patial combustion gas in divided plural jet streams.

16. The invention set forth in claim 1 wherein said discharging means of secondary air comprises plural nozzles provided radiously at said exit of the secondary air to spout said secondary air to form divided radious jets, and said discharging means of said partial combustion gas comprises a nozzle at said exit of the partial combustion gas to spout said partial combustion gas in a jet.

17. The invention set forth in claim 1 wherein said discharging means of said secondary air comprises plural nozzles provided radiously at said exit of the secondary air to spout said secondary air to form divided radious jets, and said discharging means of said partial combustion gas comprises a rotating means at said exit of the partial combustion gas to spout said partial combustion gas to form a rotating flow.

18. The invention set forth in claim 1 wherein said discharging means of said secondary air comprises plural nozzle provided radiously at said exit of the secondary air to spout said secondary air to form divided radious jets, and said discharging means of said partial combustion gas comprises a cone at said exit of the partial combustion gas to spout said partial combustion gas to form a circular flow having an enlarged surface.

19. The invention set forth in claim 1 wherein said discharging means of said secondary air comprises plural nozzles provided radiously at said exit of the secondary air to spout said secondary air to form divided radious flows, and said discharging means of said partial combustion gas comprises appropriate holes at said exit of the partial combustion gas to spout said partial combustion gas in perpendicular directions to the original stream of said partial combustion gas.

20. The invention set forth in claim 1 wherein said discharging means of said secondary air comprises plural nozzles provided radiously at said exit of the secondary air to spout said secondary air to form divided radious flows, and said discharging means of said partial combustion gas comprises plural nozzles at said exit of the partial combustion gas to spout said partial combustion gas to form divided plural jet streams.

21. The invention set forth in claim 1 wherein said discharging means of said secondary air comprises plural divisions at said exit of the secondary air with their appropriate parts closed to form divided air flows, and said discharging means of said partial combustion gas comprises a nozzle at said exit of the partial combustion gas to spout said partial combustion gas in a jet.

22. The invention set forth in claim 1 wherein said discharging means of said secondary air comprises plural divisions at said exit of the secondary air with their appropriate parts closed to form divided air flows, and said discharging means of said partial combustion gas comprises a rotating means at said exit of the partial combustion gas to spout said partial combustion gas to form a rotating flow.

23. The invention set forth in claim 1 wherein said discharging means of said secondary air comprises plural divisions at said exit of the secondary air with their appropriate parts closed to form divided air flows, and said discharging means of said partial combustion gas comprises a cone at said exit of the partial combustion gas to spout said partial combustion gas to form a circular flow having an enlarged surface.

24. The invention set forth in claim 1 wherein said discharging means of said secondary air comprises plural divisions at said secondary air with their appropriate parts closed to form divided air flows, and said discharging means of said partial combustion gas comprises an appropriate holes at said exit of the partial combustion gas to spout said combustion gas in perpendicular directions to the original stream of said partial combustion gas.

25. The invention set forth in claim 1 wherein said discharging means of said secondary air comprises plural divisions at said exit of the secondary air with their appropriate parts closed to form divided air flows, and said discharging means of said partial combustion gas comprises plural nozzles at said exit of the partial combustion gas to spout said partial combustion gas in divided plural jet streams.

26. The invention set forth in claim 1 wherein said discharging means of said secondary air comprises plural prolonged pipes to spout the secondary air downstream of said partial combustion gas, and said discharging means of said plural combustion gas comprises a nozzle at said exit of the partial combustion gas to spout said partial combustion gas in a jet.

27. The invention set forth in claim 1 wherein said discharging means of said secondary air comprises plural prolonged pipes to spout the secondary air downstream of said partial combustion gas, and said discharging means of said partial combustion gas comprises a rotating means at said exit of the partial combustion gas to spout said partial combustion gas to form a rotating flow.

Figure 27:
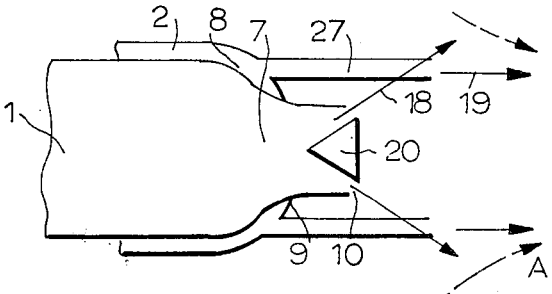
Figure 27A:
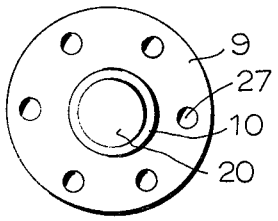
Figure 28:
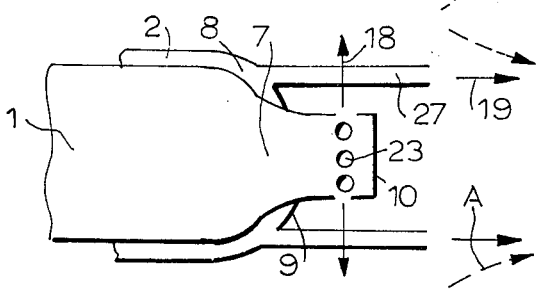
Figure 28A:
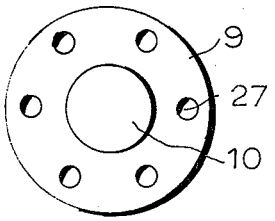
Figure 29:
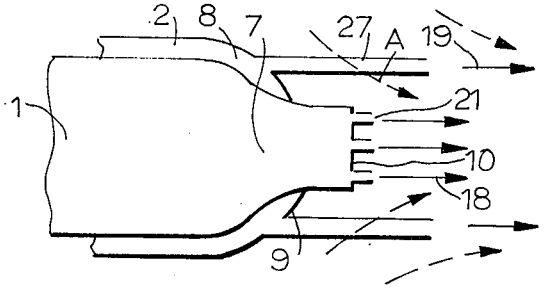
Figure 29A:
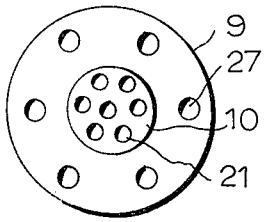
Figure 30:
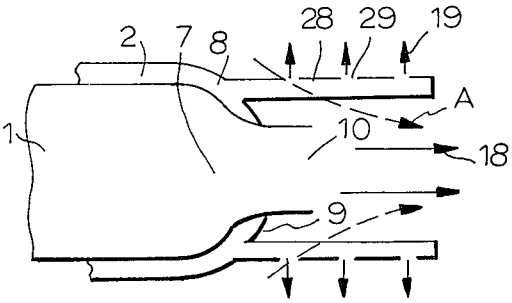
Figure 30A:
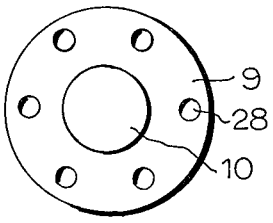
Figure 31:
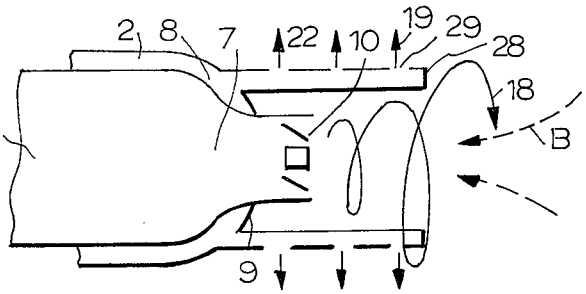
Figure 31A:
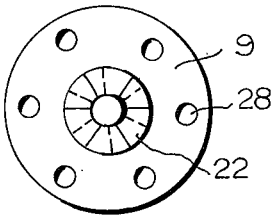
Figure 32:
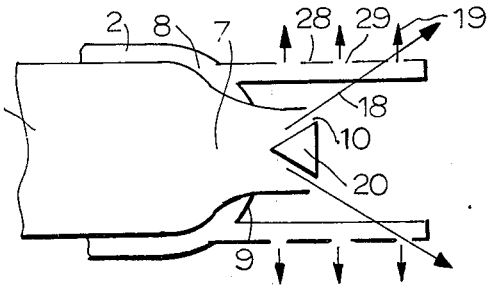
Figure 32A:
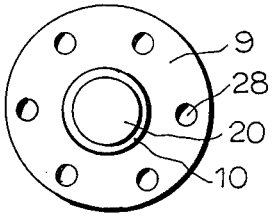
Figure 33:
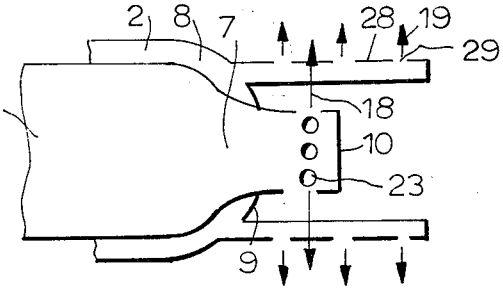
Figure 33A:
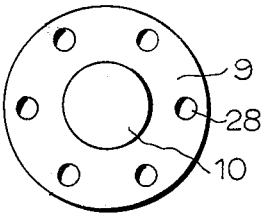
Figure 34:
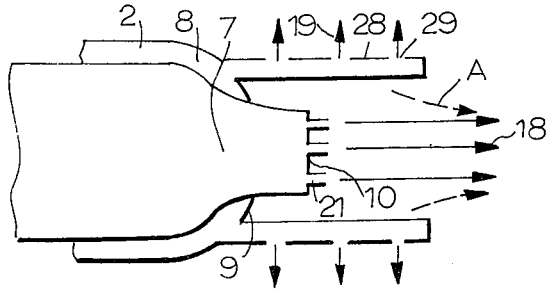
Figure 34A:
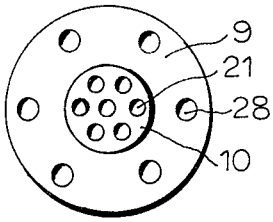

28. The invention set forth in claim 1 wherein said discharging means of said secondary air comrprises plural prolonged pipes to spout the secondary air downstream of said partial combustion gas, and said discharging means of said partial combustion gas comprises a cone at said exit of the partial combustion gas to spout said partial combustion gas to form a circular flow having an enlarged surface, as shown in FIG. 27.

29. The invention set forth in claim 1 wherein said discharging means of said secondary air comprises plural prolonged pipes to spout the secondary air downstream of said partial combustion gas, and said discharging means of said partial combustion gas comprises an appropriate holes at said exit of the partial combustion gas to spout said combustion gas in perpendicular directions to the original stream of said partial combustion gas.

30. The invention set forth in claim 1 wherein said discharging means of said secondary air comprise plural prolonged pipes to spout the secondary air downstream of said partial combustion gas, and said discharging means of said partial combustion gas comprises plural nozzles at said exit of the partial combustion. to spout said combustion gas to form divided plural jet streams.

31. The invention set forth in claim 1 wherein said discharging means of said secondary air comprises plural prolonged pipes arranged in a circle at the exit of said secondary air and said pipes are made porous outside to spout said secondary air to outer directions of said circle, and said discharging means of said partial combustion gas comprises a nozzle at said exit of the partial combustion gas to spout said partial combustion gas in a jet.

32. The invention set forth in claim 1 wherein said discharging means of said secondary air comprises plural prolonged pipes arranged in a circle at the exit of said secondary air, and pipes are made porous outside to spout said secondary air to outer directions of said circle, and said discharging means of said partial combustion gas comprises a rotating means at said exit of the partial combustion gas to spout said partial combustion gas to form a rotating flow.

33. The invention set forth in claim 1 wherein said discharging means of said secondary air comprises plural prolonged pipes arranged in a circle at the exit of said secondary air, and said pipes are made porous outside to spout said secondary air to outer directions of said circle, and said discharging means of said partial combustion gas comprises a cone at said exit of the partial combustion gas to spout said partial combustion gas to form a circular flow having an enlarged surface.

34. The invention set forth in claim 1 wherein said discharging means of said secondary air comprises plural prolonged pipes arranged in a circle at the exit of said secondary air, and said pipes are made porous outside to spout said secondary air to outer directions of said circle, and said discharging means of said partial combustion gas comprises appropriate holes at said exit of the partial combustion gas to spout said combustion gas in perpendicular directions to the original stream of said partial combustion gas.

35. The invention set forth in claim 1 wherein said discharging means of said secondary air comprises plural prolonged pipes arranged in a circle at the exit of said secondary air, and said pipes are made porous outside to spout said secondary air to outer directions of said circle, and said discharging means of said partial combustion gas comprises plural nozzles at said exit of the partial combustion gas to form divided plural jet streams.

* * * * *